US008186981B2

(12) United States Patent
Sugimoto et al.

(10) Patent No.: US 8,186,981 B2
(45) Date of Patent: May 29, 2012

(54) SCROLL COMPRESSOR HAVING A SPRING MEMBER PRESSING AN ECCENTRIC SHAFT ONTO A SLIDE FACE OF A SLIDE BUSH

(75) Inventors: Kazuyoshi Sugimoto, Gunma-ken (JP); Kazuya Sato, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 325 days.

(21) Appl. No.: 12/407,196

(22) Filed: Mar. 19, 2009

(65) Prior Publication Data

US 2009/0246057 A1 Oct. 1, 2009

(30) Foreign Application Priority Data

Mar. 27, 2008 (JP) ..... 2008-82985

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/150; 418/55.1; 418/55.5; 418/57

(58) Field of Classification Search ..... 418/14, 418/55.1–55.6, 57, 150
See application file for complete search history.

(56) References Cited

U.S. PATENT DOCUMENTS

| | | | | |
|---|---|---|---|---|
| 5,496,157 | A * | 3/1996 | Shoulders et al. | 418/14 |
| 5,545,019 | A * | 8/1996 | Beck et al. | 418/55.1 |
| 6,106,251 | A * | 8/2000 | Monnier et al. | 418/14 |

FOREIGN PATENT DOCUMENTS

| | | | |
|---|---|---|---|
| JP | 7-71386 | | 3/1995 |
| JP | 2000179474 | A * | 6/2000 |
| JP | 3165153 | B1 | 3/2001 |

OTHER PUBLICATIONS

JP 2000179474 A, Araki, Jun. 2000—English Translation.*

* cited by examiner

*Primary Examiner* — Theresa Trieu
(74) *Attorney, Agent, or Firm* — Kratz, Quintos & Hanson, Ltd.

(57) ABSTRACT

There is disclosed a scroll compressor having an object of stabilizing the moving of an orbit scroll while suppressing the start load of the scroll compressor. In the scroll compressor, a slide bush having a slide face forming a predetermined angle with respect to the direction of gas load of a gas in a compression chamber is interposed on an eccentric shaft of a shaft for driving the orbit scroll, so that when the load of the gas in the compression chamber is applied, the eccentric amount of the eccentric shaft increases. The scroll compressor includes a spring member interposed between the slide bush and the eccentric shaft and configured to constantly urge the eccentric shaft to decrease the eccentric amount of the eccentric shaft, and this spring member urges the eccentric shaft to press the eccentric shaft onto the slide face of the slide bush.

2 Claims, 5 Drawing Sheets

SCROLL COMPRESSOR HAVING A SPRING MEMBER PRESSING AN ECCENTRIC SHAFT ONTO A SLIDE FACE OF A SLIDE BUSH

BACKGROUND OF THE INVENTION

The present invention relates to a scroll compressor in which laps are formed on the mutually facing faces of a fixed scroll and a mirror plate of an orbit scroll which revolves in the orbit with respect to the fixed scroll, and the laps are engaged with each other to form a plurality of compression chambers.

Heretofore, this type of scroll compressor has a fixed scroll and an orbit scroll which revolves in the orbit with respect to this fixed scroll, spiral laps are formed on the mutually facing faces of the fixed scroll and a mirror plate of the orbit scroll, and the laps are engaged with each other to form a plurality of compression chambers.

A slide bush is interposed on an eccentric shaft of a motor which drives the orbit scroll. This slide bush has a slide face forming a predetermined angle with respect to the direction of gas load of a gas in each compression chamber. When the load of the gas in the compression chamber is applied, the eccentric amount of the eccentric shaft increases.

It is known that according to such a constitution, the slide face can exert the component force of the gas load to increase the eccentric amount, and hence seal properties between both the laps of the fixed scroll and the orbit scroll can be improved to improve the performance of the compressor (e.g., see Japanese Patent Application Laid-Open No. 7-71386) (Patent Document 1)).

As such a scroll compressor, a compressor is developed in which a spring member is interposed between the slide bush and the eccentric shaft, and the spring member presses the eccentric shaft in an eccentric direction, to decrease the eccentric amount at a start, thereby decreasing a load at the start.

Specifically, in the above scroll compressor, when the spring member presses the eccentric shaft in the eccentric direction, the eccentric amount decreases at a stop, and a clearance between both the laps increases, so that the start load can be decreased.

On the other hand, when the gas load starts to be applied, the slide bush moves against the urging force of the spring member in a direction where the eccentric amount of the eccentric shaft increases, so that an adequate eccentric amount can be obtained (e.g., see Japanese Patent No. 3165153 (Patent Document 2)).

However, in the scroll compressor in which the spring member presses the eccentric shaft in the eccentric direction as described above to obtain a variable eccentric amount of the eccentric shaft, a problem occurs that during an operation, the slide face of the slide bush comes away from the eccentric shaft to cause backlash.

The present invention has been developed to solve such a conventional technical problem, and an object thereof is to stabilize the moving of the orbit scroll while suppressing the start load of the scroll compressor.

SUMMARY OF THE INVENTION

A scroll compressor according to a first aspect of the present invention comprises: a fixed scroll; and an orbit scroll which revolves in the orbit with respect to this fixed scroll, spiral laps being formed on the mutually facing faces of the fixed scroll and a mirror plate of the orbit scroll, respectively, the laps being engaged with each other to form a plurality of compression chambers, an eccentric shaft of a motor which drives the orbit scroll being provided with a slide bush having a slide face forming a predetermined angle with respect to the direction of gas load of a gas in each compression chamber, so that when the load of the gas in the compression chamber is applied, the eccentric amount of the eccentric shaft increases, the scroll compressor further comprising: a spring member interposed between the slide bush and the eccentric shaft and configured to constantly urge the eccentric shaft to decrease the eccentric amount of the eccentric shaft, characterized in that this spring member urges the eccentric shaft to press the eccentric shaft onto the slide face of the slide bush.

In the scroll compressor according to a second aspect of the present invention, the present invention of the first aspect further comprises: a spring receiving portion formed in the inner surface of the slide bush to receive the spring member, characterized in that the spring receiving portion on the side of the orbit scroll is provided with a closing portion which regulates the movement of the spring member.

According to the first aspect of the present invention, the scroll compressor comprises the fixed scroll, and the orbit scroll which revolves in the orbit with respect to this fixed scroll. The spiral laps are formed on the mutually facing faces of the fixed scroll and the mirror plate of the orbit scroll, respectively, and the laps are engaged with each other to form a plurality of compression chambers. Moreover, the eccentric shaft of the motor which drives the orbit scroll is provided with the slide bush having the slide face forming the predetermined angle with respect to the direction of gas load of the gas in each compression chamber, so that when the load of the gas in the compression chamber is applied, the eccentric amount of the eccentric shaft increases. The scroll compressor including such a constitution further comprises the spring member interposed between the slide bush and the eccentric shaft and configured to constantly urge the eccentric shaft to decrease the eccentric amount of the eccentric shaft. Therefore, the eccentric amount at a stop is small, a clearance between both the laps increases, and a load at a start can be decreased.

Moreover, when the scroll compressor starts an operation, the slide bush forms the predetermined angle with respect to the direction of gas load of the slide face, thereby generating a component force, and the slide bush moves in a direction where the eccentric amount of the eccentric shaft increases, so that an adequate eccentric amount can be obtained.

Furthermore, since the spring member urges the eccentric shaft to press the eccentric shaft onto the slide face of the slide bush, the eccentric shaft can constantly be pressed onto the slide face of the slide bush, to come in close contact with the slide face. In consequence, it is possible to securely eliminate a disadvantage that the slide face of the slide bush comes away from the eccentric shaft to cause backlash.

In general, while suppressing the start load, the moving of the orbit scroll can be stabilized, and the performance and the reliability of the scroll compressor can be improved.

In particular, according to the second aspect of the present invention, the first aspect of the present invention further comprises the spring receiving portion formed in the inner surface of the slide bush to receive the spring member, and the spring receiving portion on the side of the orbit scroll is provided with a closing portion which regulates the movement of the spring member. Therefore, the closing portion can avoid in advance a disadvantage that the spring member jumps out toward the orbit scroll.

DESCRIPTION OF THE PREFERRED EMBODIMENT

The present invention has been developed to eliminate a problem that the moving of an orbit scroll becomes unstable, for example, a problem that the slide face of a slide bush comes away from an eccentric shaft during an operation, in a scroll compressor in which a spring member is interposed between the slide bush and the eccentric shaft, and presses the eccentric shaft in an eccentric direction, to obtain the variable eccentric amount of the eccentric shaft. Thus, an object to stabilize the moving of the orbit scroll while suppressing the start load of the scroll compressor is realized by interposing, between the slide bush and the eccentric shaft, the spring member which constantly urges the eccentric shaft to decrease the eccentric amount of the eccentric shaft and which urges the eccentric shaft to press the eccentric shaft onto the slide face of the slide bush. Hereinafter, an embodiment of the present invention will be described with reference to the drawings.

Figure 1:
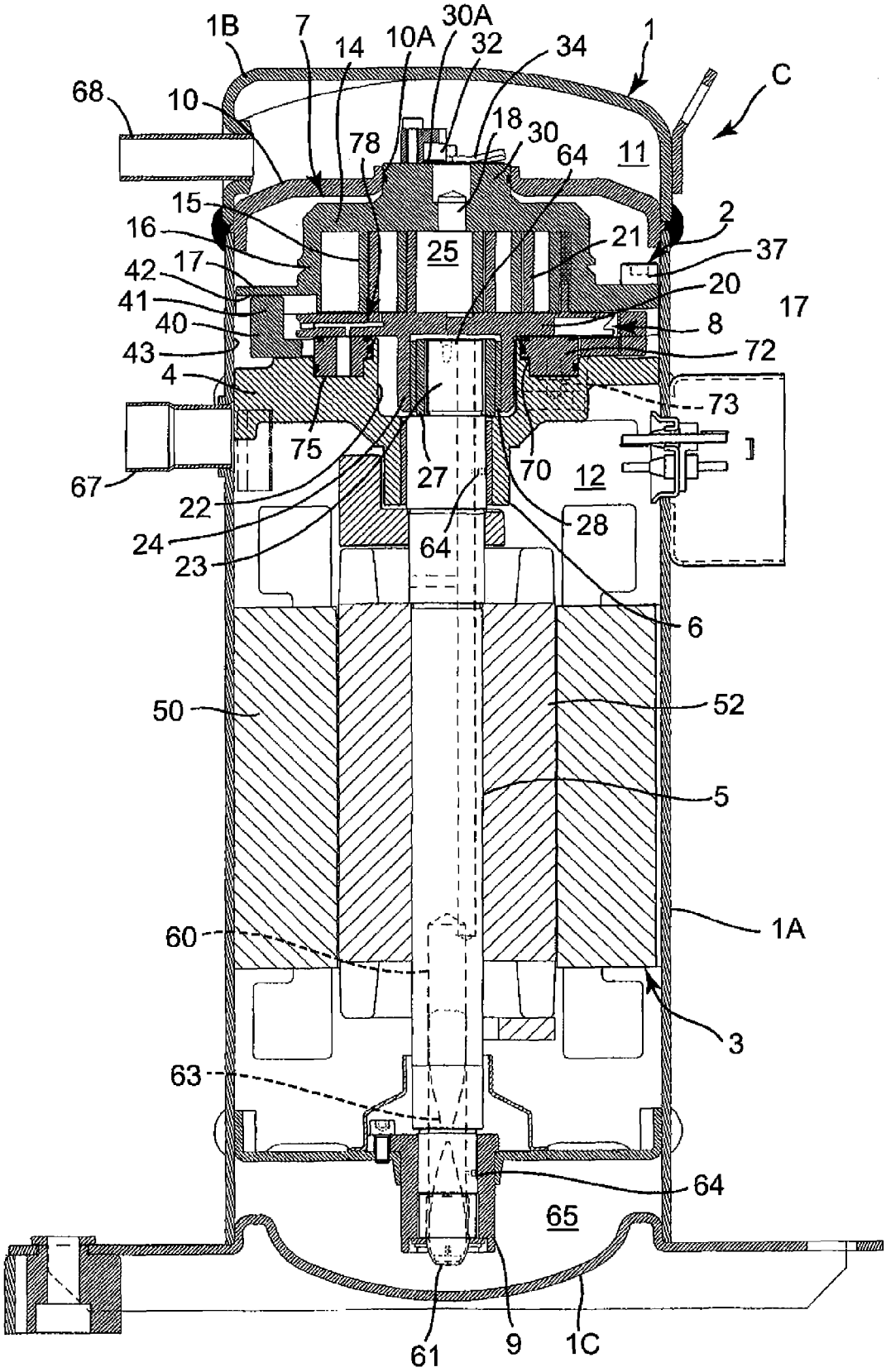
FIG. 1 is a vertical side view of one embodiment of a scroll compressor (Embodiment 1)
Figure 2:
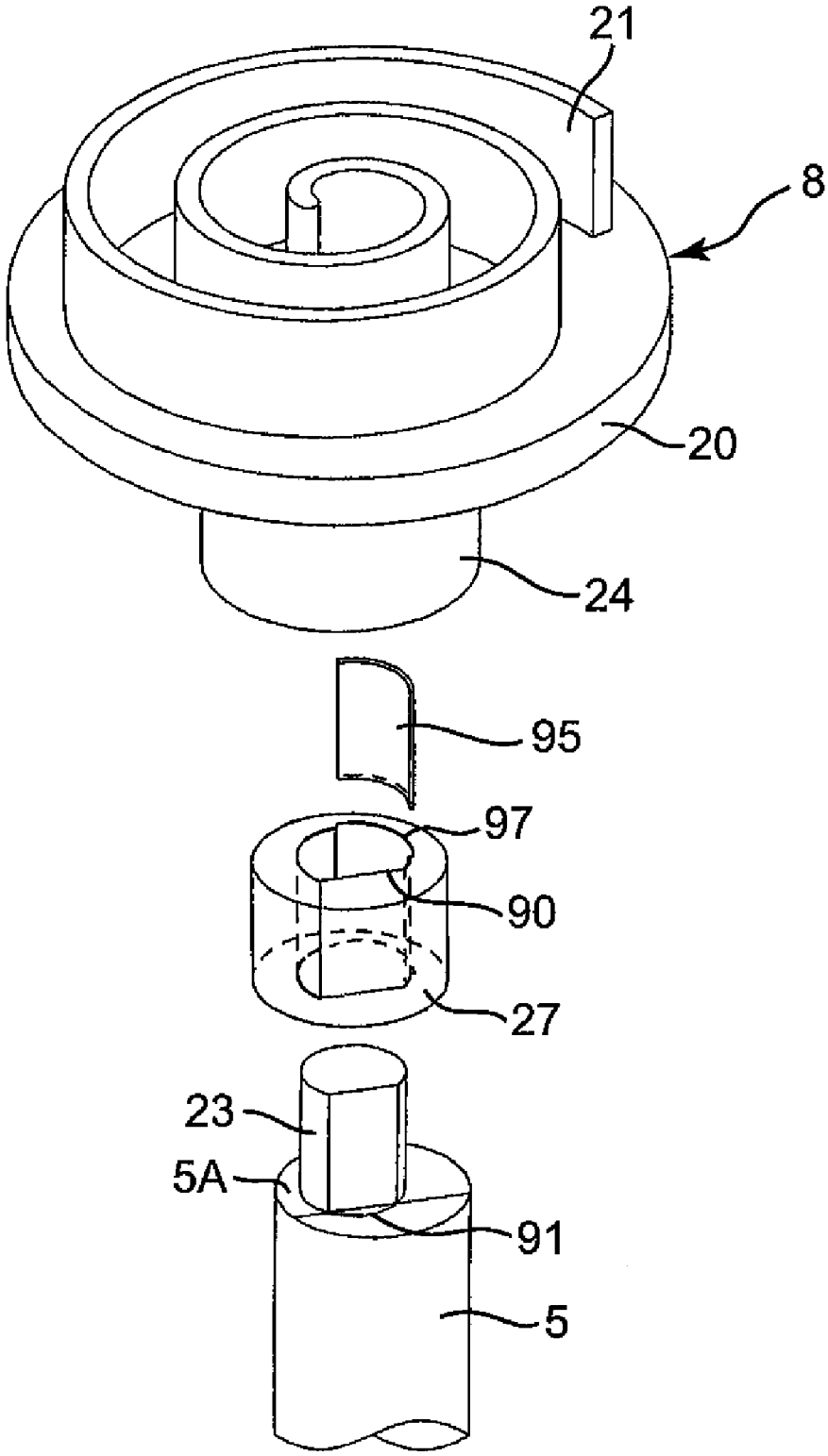
FIG. 2 is an exploded diagram around an eccentric shaft of a motor of the scroll compressor of FIG. 1.

FIG. 1 shows a vertical side view of one embodiment of a scroll compressor to which the present invention is applied, and FIG. 2 shows an exploded diagram around an eccentric shaft 23 of a shaft 5 of the motor element 3. In FIG. 1, reference numeral 1 is a sealed container. This sealed container 1 is constituted of a container main body 1A having a vertically long cylindrical shape, and an end cap 1B and a bottom cap 1C fixedly welded to both ends (both of upper and lower ends) of this container main body 1A and each substantially having a bowl-like shape.

Moreover, on the upside in this sealed container 1 is provided a partition plate 10 which vertically partitions a space in the sealed container 1. That is, the inside of the sealed container 1 is partitioned into an upper space 11 and a lower space 12 by the partition plate 10.

In the lower space 12 of the sealed container 1 are received a compression element 2 on the upside and a motor element 3, as driving means for driving this compression element 2, on the downside. Moreover, a bottom portion (i.e., the inner surface of the bottom cap 1C) 65 of the space 12 is an oil reservoir in which a lubricant for lubricating the compression element 2 and the like is received. A support frame 4 is received between this compression element 2 and the motor element 3 in the sealed container 1, and this support frame 4 is provided with a bearing 6 and a boss receiving portion 22 in the center of the support frame. This bearing 6 supports the tip (the upper end) of the shaft 5, and is formed to protrude downwards from the center of one surface (the lower surface) of the support frame 4. Moreover, the boss receiving portion 22 receives a boss 24 of an orbit scroll 8 described later, and is formed by depressing downwards the center of the other surface (the upper surface) of the support frame 4.

Moreover, the tip (the upper end) of the shaft 5 is provided with the eccentric shaft 23. The center of this eccentric shaft 23 is provided to deviate from the shaft center of the shaft 5 eccentrically, and this eccentric shaft is drivably and turnably inserted into the boss 24 through a slide bush 27 and a turning shaft receiver 28.

The compression element 2 is constituted of a fixed scroll 7 and the orbit scroll 8. The fixed scroll 7 is constituted of a disc-like mirror plate 14, a spiral lap 15 vertically provided on one surface (the lower surface) of this mirror plate 14 and having an involute shape or a curved shape approximated to this involute shape, a peripheral wall 16 vertically provided so as to surround the periphery of this lap 15, and a flange 17 provided around this peripheral wall 16 and having the outer peripheral edge thereof burned and fitted into the inner surface of the container main body 1A of the sealed container 1. The center of the mirror plate 14 of the fixed scroll 7 is provided with a discharge hole 18 which communicates with the upper space 11 of the sealed container 1 partitioned by the partition plate 10. Moreover, the lap 15 protrudes downwards in the fixed scroll 7.

In the constitution of the present embodiment, the mirror plate 14 of the fixed scroll 7 includes a cylindrical protruding portion 30 protruding from the other surface (the upper surface) of the mirror plate 14 and having the discharge hole 18. Moreover, this protruding portion 30 fits into a holding hole 10A formed in the partition plate 10, and an upper surface 30A of the protruding portion 30 is opposed to the upper space 11 of the partition plate 10. The upper surface 30A of the protruding portion 30 is provided with a discharge valve 32 which opens/closes the discharge hole 18, and a plurality of release valves 34 disposed adjacent to the discharge valve 32. The release valves 34 are provided to prevent the excessive compression of the refrigerant, and connected to a compression space (a compression chamber 25) of a compression process described later through a release port (not shown).

Specifically, when the refrigerant pressure of the compression process increases a discharge pressure before reaching the discharge hole 18, the release valves 34 are opened to discharge the refrigerant from the compression space 25 (the compression chamber 25) through the release port.

On the other hand, the orbit scroll 8 is a scroll which revolves in the orbit with respect to the fixed scroll 7, and is constituted of a disc-like mirror plate 20, a spiral lap 21 vertically provided on one surface (the upper surface) of this mirror plate 20 and having an involute shape or a curved shape approximated to this involute shape, and the boss 24 protruding from the center of the other surface (the lower surface) of the mirror plate 20. Moreover, in the orbit scroll 8, the lap 21 protrudes upwards, this lap 21 is arranged so that when the lap is turned as much as 180 degrees, the lap faces and engages with the lap 15 of the fixed scroll 7, and a plurality of compression spaces are formed between the inner laps 15 and 21.

That is, the lap 21 of the orbit scroll 8 faces the lap 15 of the fixed scroll 7, and the tip surfaces of both the laps 21, 15 engage with each other so that the tip surface of one of the laps comes in contact with the bottom surface of the other lap. Moreover, the orbit scroll 8 is fitted into the eccentric shaft 23 provided to deviate from the shaft center of the shaft 5. Therefore, the two spiral laps 21, 15 are mutually eccentrically disposed, and come in contact with each other along the eccentric direction to form a plurality of sealed spaces, so that the respective spaces form the compression chambers 25.

In the fixed scroll 7, the flange 17 provided around the peripheral wall 16 of the fixed scroll is fixed to the support frame 4 via a plurality of bolts 37. Moreover, the orbit scroll 8 is supported by the support frame 4 via an Oldham's ring 40. This Oldham's ring 40 revolves the orbit scroll 8 along a circular orbit so that the orbit scroll does not rotate itself with respect to the fixed scroll 7, and includes a pair of Oldham's keys 41, 41 formed to protrude upwards at facing positions.

These Oldham's keys 41, 41 slidably engage with a key groove 42 formed in the lower surface of the fixed scroll 7. In this case, when the orbit scroll revolves, the Oldham's rings 40, 40 slide along the extending direction of the Oldham's keys 41 in a sliding space 43 formed between the fixed scroll 7 and the support frame 4.

Furthermore, the orbit scroll 8 revolves eccentrically with respect to the fixed scroll 7. Therefore, eccentric directions and the contact positions of the two spiral laps move while rotating, and the compression chamber is reduced while moving from the outer compression chamber to the inner compression chamber 25. First, a low-pressure refrigerant gas enters the outer compression chamber 25, is confined, and moves inwards while being insulated and compressed. Finally, when the gas reaches the center, the gas forms a high-temperature high-pressure refrigerant gas. This refrigerant gas is fed to the space 11 through the discharge hole 18 provided in the center.

On the other hand, the motor element 3 is constituted of a stator 50 fixed to the sealed container 1, and a rotor 52 arranged on the inner side of the stator 50 to rotate in the stator 50. The shaft 5 is fitted into the center of the rotor 52. The terminal end (the lower end) of the shaft 5 is supported by a bearing 9 arranged in the bottom portion of the sealed container 1.

Moreover, in the shaft 5, an oil path 60 is formed along the axial direction of the shaft 5. This oil path 60 includes a suction port 61 positioned at the lower end of the shaft 5, and a paddle 63 formed above the suction port 61. The lower end of the shaft 5 is immersed into the lubricant received in the oil reservoir 65, and the suction port 61 of the oil path 60 opens in the lubricant. Furthermore, an oil supply port 64 for supplying the lubricant is formed at a position corresponding to each bearing in the oil path 60. According to such a constitution, when the shaft 5 rotates, the lubricant received in the oil reservoir 65 enters the oil path 60 from the suction port 61 of the shaft 5, and is pumped up along the paddle 63 of the oil path 60. In addition, the pumped-up lubricant is supplied to each bearing or a sliding portion of the compression element 2 through each oil supply port 64 or the like.

On the other hand, the sealed container 1 is provided with a refrigerant suction tube 67 for introducing the refrigerant into the lower space 12 of the sealed container 1, and a refrigerant discharge tube 68 for discharging, to the outside, the refrigerant compressed by the compression element 2 and discharged into the upper space 11 of the sealed container 1 through the discharge hole 18. In the present embodiment, the refrigerant suction tube 67 is fixedly welded to the side surface of the container main body 1A of the sealed container 1, and the refrigerant discharge tube 68 is fixedly welded to the side surface of the end cap 1B.

Moreover, in the upper surface of the support frame 4, an annular ring groove 70 is formed in the periphery of the boss receiving portion 22, and a thrust ring 72 formed of an iron-based sintered member is arranged in the ring groove 70. The thrust ring 72 supports the mirror plate 20 of the orbit scroll 8, and decreases a sliding resistance between the orbit scroll 8 and the support frame 4 during the moving of the orbit scroll 8. A positioning pin 73 is protruded from the lower surface of the thrust ring 72, and the positioning pin 73 is inserted into an engagement hole (not shown) provided in the ring groove 70. Therefore, even when the orbit scroll 8 revolves above the thrust ring 72, the thrust ring 72 is positioned by the support frame 4 while the rotation of the thrust ring 72 is stopped by the positioning pin 73.

Moreover, according to the constitution of the present embodiment, the orbit scroll 8 is supported movably in the axial direction toward the fixed scroll 7. When the refrigerant in the compression process by the compression element 2 is introduced into the lower surface (the back surface) of the thrust ring 72 during the driving of the compression element 2, the orbit scroll 8 can be pressed onto the fixed scroll 7 via the thrust ring 72.

Specifically, a back surface space 75 into which the refrigerant in the compression process is introduced is formed between the thrust ring 72 and the support frame 4. Moreover, at the inner peripheral edge and the outer peripheral edge of the thrust ring 72, O-rings (not shown) are arranged to secure the air tightness of the back surface space 75, respectively. Moreover, the orbit scroll 8 and the thrust ring 72 are provided with a communication hole 78 which connects the compression chamber 25 to the back surface space 75.

An opening of one end (the upper end) of the communication hole 78 is provided in the upper surface (the lap face) of the mirror plate 20 of the orbit scroll 8 at a position connected to the compression chamber 25 having an intermediate pressure. This intermediate pressure is set to a value closer to a suction pressure.

On the other hand, an opening of the other end (the lower end) of the communication hole 78 is formed in the lower surface of the thrust ring 72 to communicate with the back surface space 75, and the opening is provided so that the intermediate pressure of the compression chamber 25 can constantly be introduced into the back surface space 75 during the driving of the compression element 2. In consequence, the orbit scroll 8 can stably be pressed onto the fixed scroll 7 via the thrust ring 72.

On the other hand, the slide bush 27 is interposed along the eccentric shaft 23 of the shaft 5. As shown in FIGS. 2 to 7, this slide bush 27 has a slide face 90. The slide face 90 is formed at the slide bush 27 so as to form a predetermined angle with respect to the direction of gas load of a gas in the compression chamber 25. Specifically, in the present embodiment, as shown in FIGS. 5 to 7, the slide face 90 is formed to tilt as much as a predetermined angle $\alpha$ from an eccentric direction (an arrow D2) crossing the direction of gas load (an arrow D1) at right angles. According to such a constitution, when the load of the gas in the compression chamber 25 is applied, the slide face 90 can exert the component force of the gas load to increase an eccentric amount. In consequence, seal properties between the laps of the fixed scroll and the orbit scroll can be improved, and the performance of a scroll compressor C can be improved.

Figure 3:
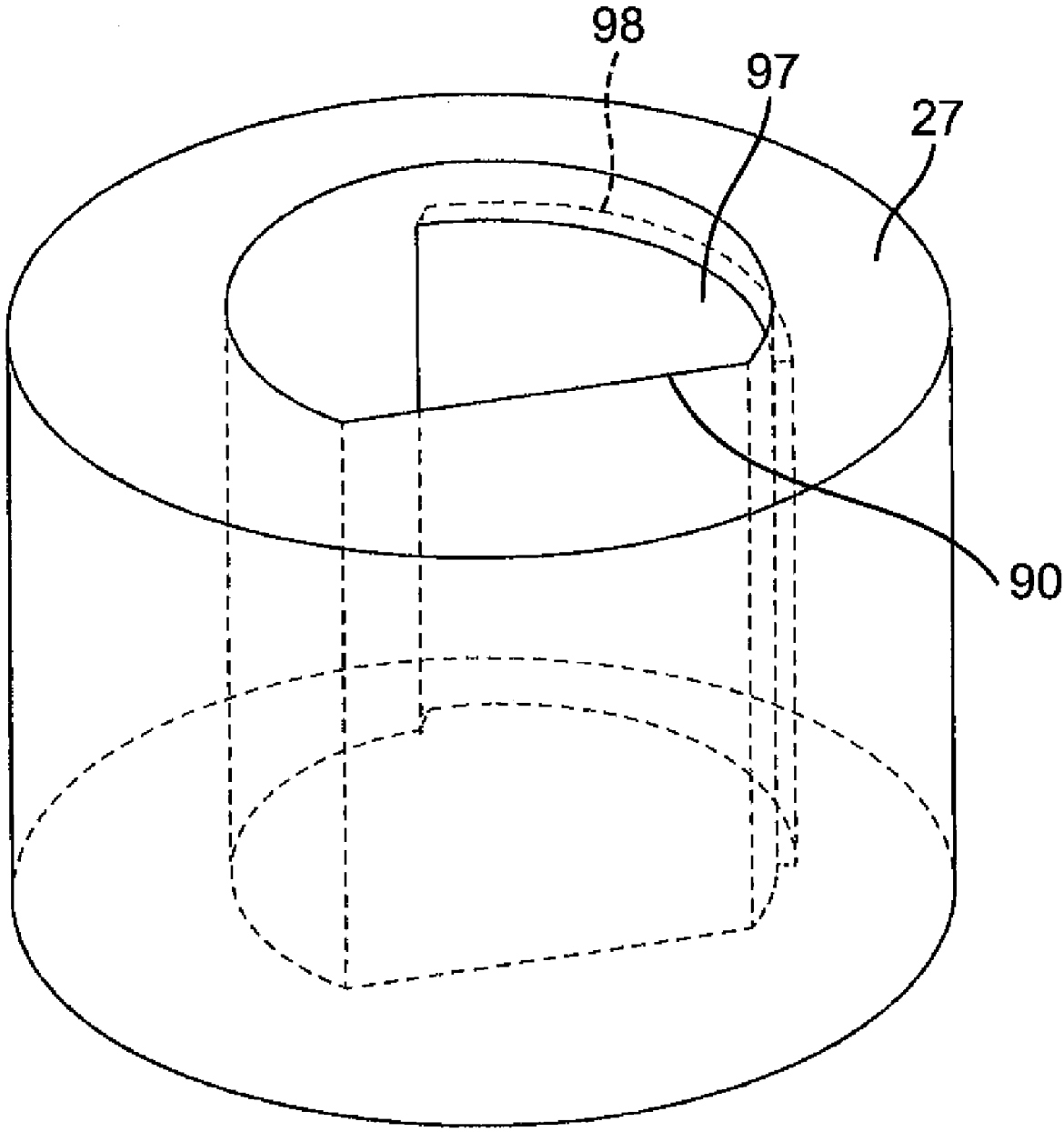
FIG. 3 is an enlarged view of a slide bush of FIG. 2.
Figure 4:
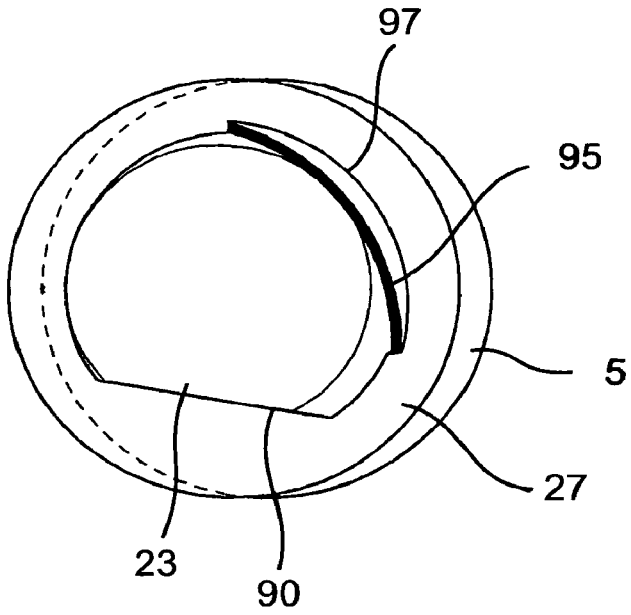
FIG. 4 is a sectional plan view of the eccentric shaft including a spring member of the present invention (at a start)
Figure 5:
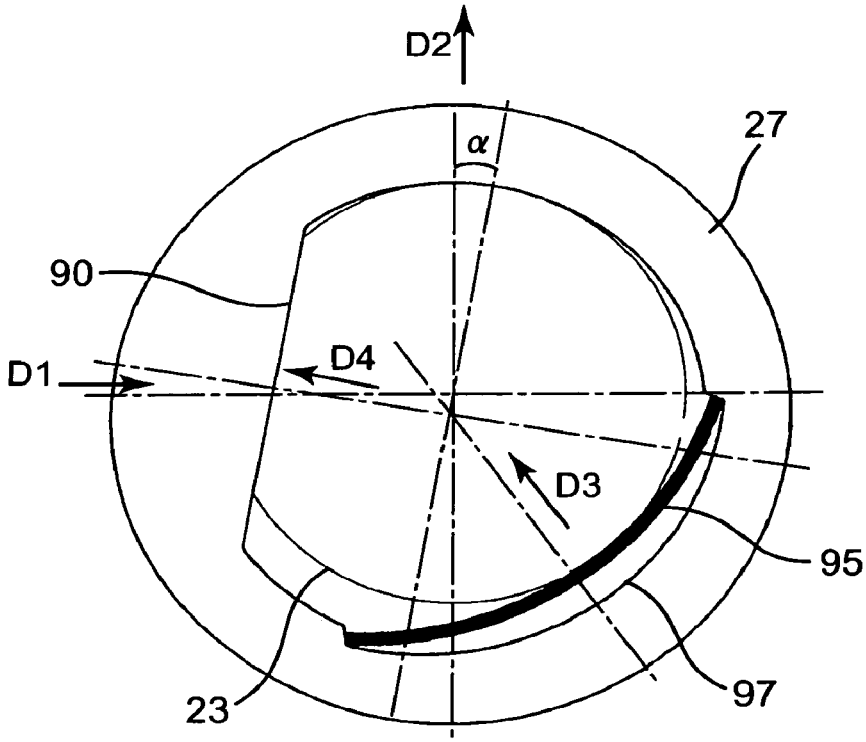
FIG. 5 is an enlarged view of FIG. 4.
Figure 6:
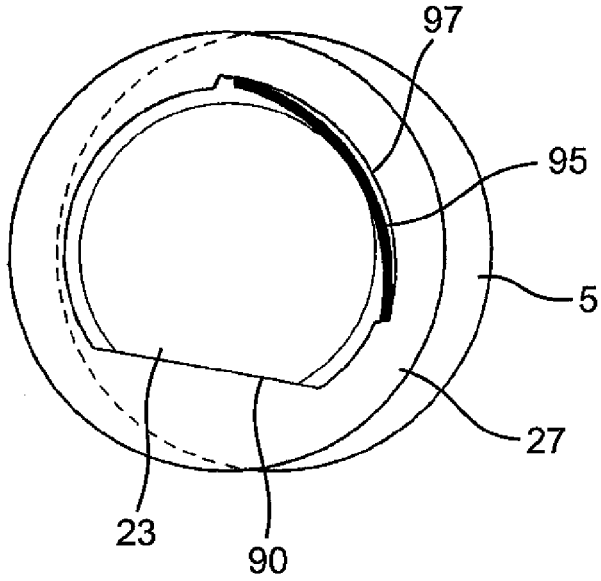
FIG. 6 is a sectional plan view of the eccentric shaft including the spring member of the present invention (during an operation)
Figure 7:
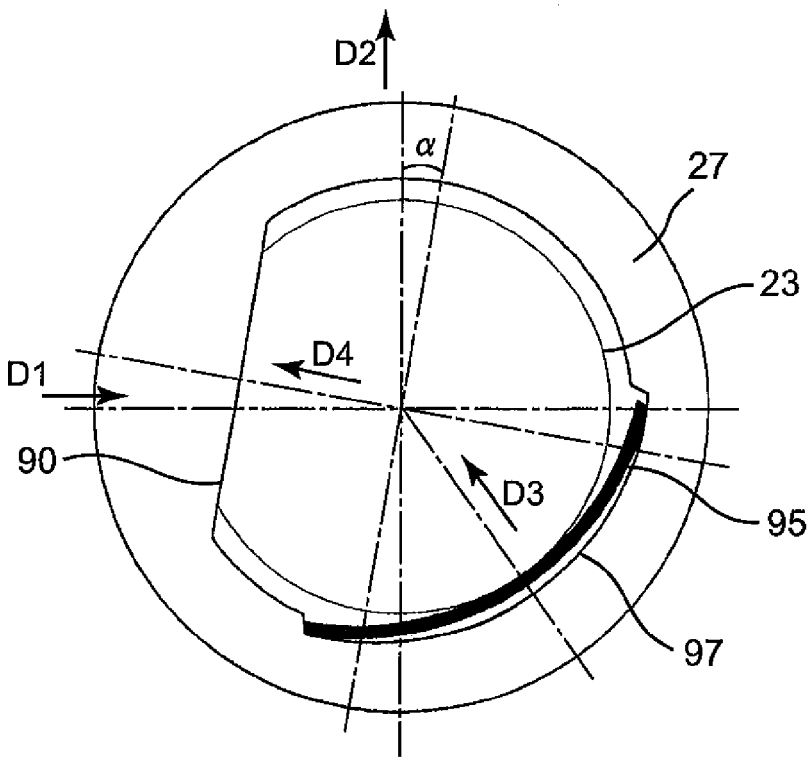
FIG. 7 is an enlarged view of FIG. 6.

It is to be noted that FIG. 3 is an enlarged view of the slide bush 27, FIG. 4 is a sectional top plan view showing a state of the shaft 5 at a start, FIG. 5 is a sectional plan view of the eccentric shaft 23 of FIG. 4, FIG. 6 is a sectional plan view showing the state of the shaft 5 during an operation, and FIG. 7 is a sectional plan view of the eccentric shaft 23 of FIG. 6. In FIG. 2, reference numeral 91 is a clearance portion formed at the face 5A of the shaft 5 on the side of the eccentric shaft 23 to absorb processing residual in a case where the slide face 90 is formed on the eccentric shaft 23.

Meanwhile, as such a scroll compressor, a compressor is also developed in which a spring member is interposed between a slide bush and an eccentric shaft, and presses the eccentric shaft in an eccentric direction, to decrease an eccentric amount at a start, thereby decreasing a load at the start. Specifically, in the above scroll compressor, when the spring member presses the eccentric shaft in the eccentric direction, the eccentric amount decreases at a stop, and a clearance between both laps increases, so that the start load can be decreased. On the other hand, when a gas load starts to be applied, the slide bush moves against the urging force of the spring member in a direction where the eccentric amount of the eccentric shaft increases, so that an adequate eccentric amount can be obtained.

However, in the scroll compressor in which the spring member presses the eccentric shaft in the eccentric direction as described above, to obtain a variable eccentric amount of the eccentric shaft, such a direction as to urge the eccentric shaft agrees with the eccentric direction of the eccentric shaft, and the eccentric shaft cannot be pressed onto the slide face. In consequence, a problem has occurred that the slide face of the slide bush comes away from the eccentric shaft during an operation to cause backlash.

Therefore, in view of such a problem, the present invention has been developed so that a spring member (a leaf spring) 95 of the present invention is disposed between the slide bush 27 and the eccentric shaft 23. This spring member 95 constantly urges the eccentric shaft 23 so that the eccentric amount of the eccentric shaft 23 decreases as in the above conventional spring member. However, the above conventional spring member presses the eccentric shaft in the eccentric direction, that is, a direction crossing a direction of gas load at right angles, whereas the spring member 95 of the present invention urges the eccentric shaft 23 to press the eccentric shaft onto the slide face 90 of the slide bush 27.

Here, a specific constitution will be described with reference to FIGS. 2 to 7. In each drawing, reference numeral 95 is a spring member of the present embodiment to which the present invention is applied. This spring member 95 is constituted of a leaf spring curved into an R-shape. Moreover, 97 is a spring receiving portion formed in the inner surface of the slide bush 27, and 98 is a closing portion for regulating the movement of the spring member 95 (FIG. 3). The closing portion 98 is formed by depressing the inner surface of the slide bush 27, that is, a part of the face adjacent to the eccentric shaft 23 in an axial center direction (an outer peripheral direction). Moreover, the closing portion 98 is formed at the spring receiving portion 97 on the side of the orbit scroll 8. While the spring member 95 is received in the spring receiving portion 97, the spring receiving portion on the side of the orbit scroll 8 is closed by the closing portion 98. In consequence, a disadvantage that the spring member 95 jumps out toward the orbit scroll 8 can be avoided in advance.

In this case, the spring member 95 is received in the spring receiving portion 97 so that the spring member can constantly urge the eccentric shaft 23 to press the slide bush 27. In particular, according to the present invention, the spring member 95 is provided to urge the eccentric shaft 23, thereby pressing the eccentric shaft onto the slide face 90 of the slide bush 27. In the present embodiment, with respect to the spring receiving portion 97, the slide bush 27 is formed in such a positional relation that the eccentric shaft 23 can be urged and pressed onto the slide face 90 of the slide bush 27 in a case where the spring member 95 is received in the spring receiving portion 97.

In the constitution of the present embodiment, when the spring member 95 is received in the spring receiving portion 97, a force to press the eccentric shaft 23 in the direction of an arrow D3 shown in FIGS. 5 and 7 is exerted. The direction (the arrow D3) of the force (hereinafter referred to as the urging force) of the spring member 95 for pressing the eccentric shaft 23 forms a predetermined angle with respect to the eccentric direction D2 as apparent from FIGS. 5 and 7. This angle is formed in a direction in which the eccentric shaft 23 is constantly pressed onto the slide face 90 of the slide bush 27. In the present embodiment, the urging force in the direction of the arrow D3 is divided into a force in such a direction as to press the slide face 90 (an arrow D4 shown in FIGS. 5 and 7) and a force in the eccentric direction (the arrow D2 shown in FIGS. 5 and 7) when exerted. That is, by the component force generated in such a direction (the arrow D4) as to press the slide face 90, the eccentric shaft 23 can be urged to constantly press the slide face 90 of the slide bush 27. Moreover, by the component force generated in the eccentric direction (the arrow D2), the eccentric shaft 23 can constantly be urged to decrease the eccentric amount of the eccentric shaft 23.

On the other hand, the spring member 95 is configured so that a gap is formed between the outer peripheral surface of the spring member 95 and the wall face of the spring receiving portion 97 facing the outer peripheral surface while the spring member is received in the spring receiving portion 97. In the present embodiment, the curvature radii of the spring member 95 and the spring receiving portion 97 are set so that the gap is formed between the outer peripheral surface of the spring member 95 and the wall face of the spring receiving portion 97 facing the outer peripheral surface while the spring member 95 is received in the spring receiving portion 97.

Specifically, R3 is preset to a value smaller than R0, R1 or R2, in which R0 is the curvature radius of the spring member 95 before the spring member 95 is received in the spring receiving portion 97 (at a time when the leaf spring is opened), R1 is the curvature radius of the spring member 95 while the spring member 95 is received in the spring receiving portion 97 and any gas load in the compression chamber 25 is not applied to the spring member 95, that is, at the stop of the scroll compressor C, R2 is the curvature radius of the spring member 95 at a time when the gas load in the compression chamber 25 is applied to the spring member 95 (during an operation), and R3 is the curvature radius of the spring receiving portion 97. That is, since the curvature radius (R0, R1 or R2) of the spring member 95 is larger than the curvature radius R3 of the spring receiving portion 97, the gap is necessarily formed between the spring receiving portion 97 and the spring member 95 while the spring member is received in the spring receiving portion 97.

There will be described the operation of the spring member 95 at the stop of the scroll compressor C and during the operation of the scroll compressor having the above constitution. First, at the stop of the scroll compressor C (similarly at the start), any gas load is not applied, and hence the eccentric shaft 23 is brought into a state shown in FIGS. 4 and 5 by the urging force of the spring member 95. Then, from this state, the scroll compressor C starts. In such an arrangement relation, the eccentric amount of the eccentric shaft 23 is small, and a large clearance is formed between both the laps, so that a compression work is hardly performed. In consequence, the load at the start can be decreased.

Subsequently, when the scroll compressor C starts the operation and the gas load in the compression chamber 25 starts to be applied, the component force is generated by the predetermined angle of the slide face 90 of the slide bush 27 with respect to the direction of gas load (the component force of the gas load). That is, when the scroll compressor C starts the operation, the gas load in the compression chamber 25 is applied in a direction crossing the eccentric direction at right angles. However, since the slide face 90 is formed so as to form the predetermined angle with respect to the direction of gas load, the component force is generated by the predetermined angle of the slide face 90 of the slide bush 27 with respect to the direction of gas load, and the slide bush moves against the urging force of the spring member 95 in a direction where the eccentric amount of the eccentric shaft 23 increases.

When the slide bush 27 moves in the direction where the eccentric amount of the eccentric shaft 23 increases as described above, a state shown in FIGS. 6 and 7 is brought. In consequence, the adequate eccentric amount is obtained during the operation. In this case, the spring member 95 is pressed toward the spring receiving portion 97 by the gas load and slightly elongates, and hence the curvature radius R2 becomes smaller than the curvature radius R1 at the stop (i.e., R0>R1>R2). However, since the curvature radius R2 of the spring member 95 is larger than the curvature radius R3 of the spring receiving portion 97 even during the operation (i.e., a relation of R0>R1>R2>R3), the gap is held between the spring member 95 and the spring receiving portion 97.

Moreover, since the eccentric shaft 23 is pressed onto the slide face 90 by the spring member 95 even during the operation (i.e., constantly), a close contact state between the eccentric shaft 23 and the slide face 90 of the slide bush 27 is maintained. In consequence, it is possible to securely eliminate a disadvantage that the slide face 90 of the slide bush 27 comes away from the eccentric shaft 23 to cause backlash.

As described above in detail, according to the present invention, while suppressing the load at the start, the moving of the orbit scroll 8 can be stabilized. In consequence, the performance and the reliability of the scroll compressor C can be improved.

Furthermore, as described above, the closing portion 98 formed at the spring receiving portion 97 on the side of the orbit scroll 8 closes the spring member 95 on the side of the orbit scroll 8 while the spring member 95 is received in the spring receiving portion 97, and the closing portion 98 regulates the movement of the spring member. Therefore, the disadvantage that the spring member 95 jumps out toward the orbit scroll 8 can be avoided in advance. In consequence, the reliability of the scroll compressor C can further be improved.

What is claimed is:

1. A scroll compressor comprising:

a fixed scroll; and an orbit scroll which revolves in the orbit with respect to the fixed scroll, spiral laps being formed on the mutually facing faces of the fixed scroll and a mirror plate of the orbit scroll, respectively, the laps being engaged with each other to form a plurality of compression chambers, an eccentric shaft of a motor which drives the orbit scroll being provided with a slide bush having a slide face forming a predetermined angle with respect to the direction of gas load of a gas in each compression chamber, so that when the load of the gas in the compression chamber is applied, the eccentric amount of the eccentric shaft increases, the scroll compressor further comprising:

a spring member having a curvature radius interposed between the slide bush and the eccentric shaft and configured to constantly urge the eccentric shaft to decrease the eccentric amount of the eccentric shaft, and a spring receiving portion formed in the inner surface of the slide bush to receive the spring member, wherein the spring member is arranged so as to urge the eccentric shaft to press the eccentric shaft onto the slide face of the slide bush, and wherein a condition R0>R1>R2>R3 is provided, when R0 is the curvature radius of the spring member when opened, R1 is the curvature radius of the spring member when received in the spring receiving portion and any gas load in the compression chamber is not applied to the spring member, R2 is the curvature radius of the spring member at a time when the gas load in the compression chamber is applied to the spring member, and R3 is the curvature radius of the spring receiving portion.

2. The scroll compressor according to claim 1, wherein the spring receiving portion on the side of the orbit scroll is provided with a closing portion which regulates the movement of the spring member.

* * * * *